US007621708B2

(12) United States Patent
Hampel et al.

(10) Patent No.: US 7,621,708 B2
(45) Date of Patent: Nov. 24, 2009

(54) APPARATUS AND METHOD FOR PRESSING A COVER ONTO A MOVING PRINTING MATERIAL BLOCK

(75) Inventors: Klaus Hampel, Bielefeld (DE); Stephan Fritsch, Leipzig (DE); Thorsten Holtmeier, Kirchlengern (DE); Frank Sommerer, Leipzig (DE); Andreas Steinert, Beucha (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 161 days.

(21) Appl. No.: 11/724,136

(22) Filed: Mar. 14, 2007

(65) Prior Publication Data

US 2007/0214627 A1 Sep. 20, 2007

(30) Foreign Application Priority Data

Mar. 14, 2006 (DE) ..... 10 2006 012 084

(51) Int. Cl.
*B42C 11/00* (2006.01)
*B42C 13/00* (2006.01)
*B42C 11/02* (2006.01)
*B42C 11/04* (2006.01)

(52) U.S. Cl. ..... 412/11; 412/4; 412/5; 412/13; 412/19; 412/21

(58) Field of Classification Search ..... 412/4, 412/5, 11, 13, 19, 21, 29
See application file for complete search history.

(56) References Cited

U.S. PATENT DOCUMENTS 4,153,963 A 5/1979 Hawkes et al.
4,491,448 A * 1/1985 Anders et al. ..... 412/21
5,061,138 A * 10/1991 Allsopp et al. ..... 412/4
5,219,453 A * 6/1993 Furukawa et al. ..... 412/33
5,346,350 A * 9/1994 Luhman et al. ..... 412/37
5,626,452 A * 5/1997 Hawkes ..... 412/4
5,871,323 A * 2/1999 Clark ..... 412/4
6,247,226 B1 * 6/2001 Lundberg et al. ..... 29/740
6,460,843 B1 * 10/2002 Dim et al. ..... 270/58.07

(Continued)

FOREIGN PATENT DOCUMENTS

CH 433 186 4/1967

(Continued)

*Primary Examiner*—Dana Ross
*Assistant Examiner*—Kyle Grabowski
(74) *Attorney, Agent, or Firm*—Laurence A. Greenberg; Werner H. Stemer; Ralph E. Locher

(57) ABSTRACT

An apparatus for pressing a cover onto a printing material block that is moved in a transport direction has a first pressing element that can be moved in a first direction and one or more second pressing element that can be moved transversely to the first direction. The first pressing element, in particular, is a pressing table moving in the vertical direction and the second pressing element one or two pressing rail(s) that can be moved in the horizontal direction. The apparatus has a drive unit, in particular with a servo motor, to which a variable control profile can be applied via a connection to a control unit. The variable control profile allows the movement of the pressing rails, for example their stroke or the course of their stroke, to be adapted to the current processing job. The apparatus is particularly suited for use in adhesive binders.

16 Claims, 1 Drawing Sheet

U.S. PATENT DOCUMENTS

| | | | | |
|---|---|---|---|---|
| 6,726,423 | B2 * | 4/2004 | Hocking | 412/1 |
| 6,796,553 | B2 * | 9/2004 | Hampel | 270/52.18 |
| 2001/0014265 | A1 * | 8/2001 | Holtmeir et al. | 412/5 |

FOREIGN PATENT DOCUMENTS

| | | | |
|---|---|---|---|
| CH | 626 833 | | 12/1981 |
| DE | 33 40 869 | C2 | 5/1985 |
| DE | 37 14 989 | A1 | 7/1988 |
| DE | 102 27 950 | A1 | 1/2004 |
| GB | 2 149 351 | A | 6/1985 |
| JP | 2000-168264 | | 6/2000 |

* cited by examiner

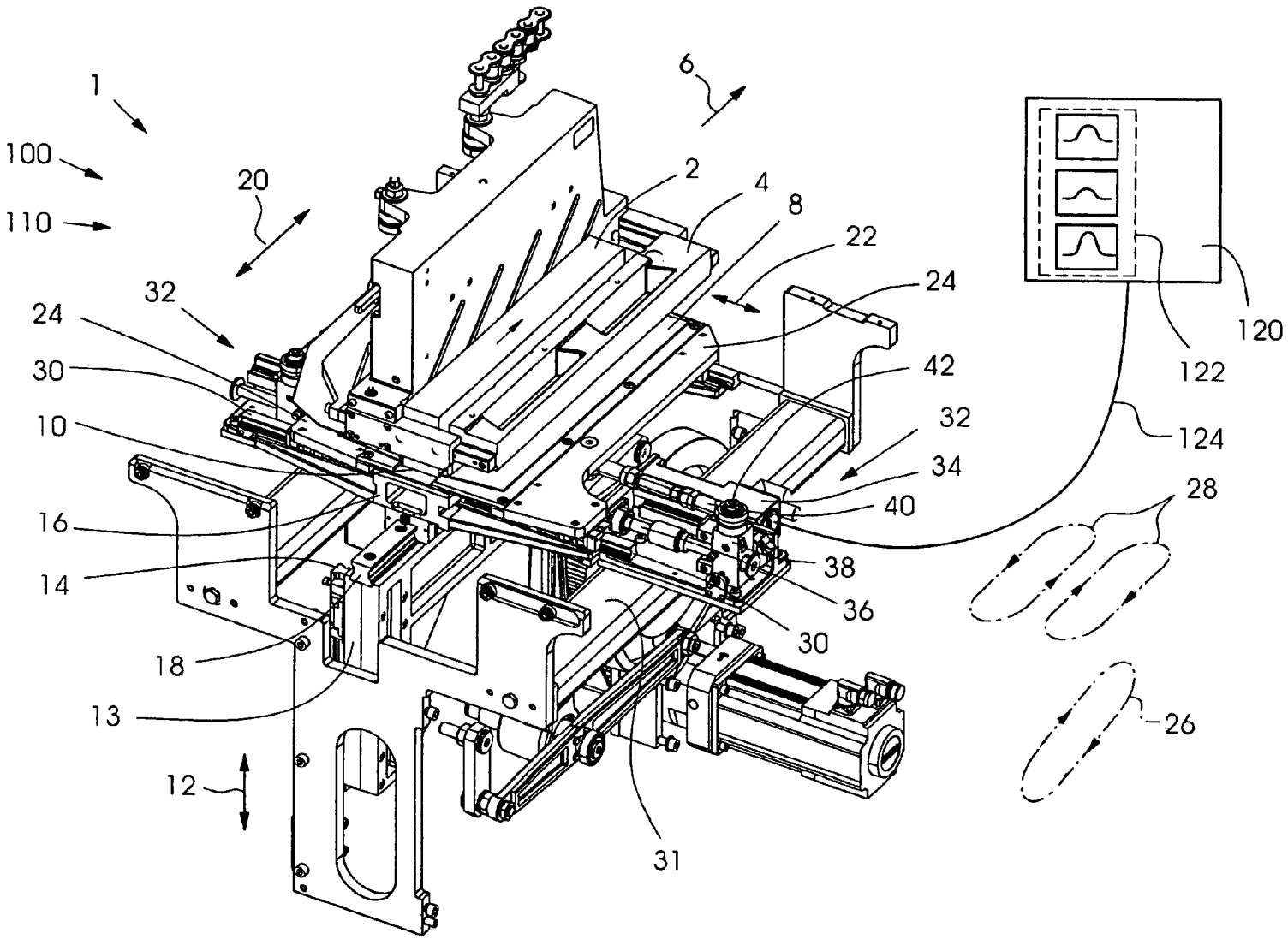
120
122
124
28
26
24
42
32
34
40
22
38
36
30
8
4
6
2
31
20
32
1
100
110
24
30
10
16
14
18
13
12

APPARATUS AND METHOD FOR PRESSING A COVER ONTO A MOVING PRINTING MATERIAL BLOCK

CROSS-REFERENCE TO RELATED APPLICATION

This application claims the priority, under 35 U.S.C. §119, of German application DE 10 2006 012 084.1, filed Mar. 14, 2006; the prior application is herewith incorporated by reference in its entirety.

BACKGROUND OF THE INVENTION

Field of the Invention

The present invention relates to an apparatus for pressing a cover onto a block of printing material moving in a given transport direction. The apparatus has a first pressing element that can be moved in a first direction and at least one second pressing element that can be moved in a second direction substantially transverse with respect to the first direction. The invention also pertains to a corresponding method of pressing a cover onto a moving printing material block.

Adhesive binding machines are used to bind a previously collated stack of signatures by using adhesives (e.g., cold glue or hot melt adhesives). As an option, before the application of adhesive, the spine can be processed by removing material. The adhesive can be applied to a book block of to a cover. In addition to gluing the block spine, the side regions of the book block close to the block spine can also be glued.

German published patent application DE 102 27 950 A1 and its counterpart U.S. Patent U.S. Pat. No. 6,796,553 B2 disclose a cover placement and cover pressing device for placing and pressing a cover onto a book block transported continuously in the conveying direction. The prior art disclosure has the following features:

- a spine pressing plate which can be moved vertically in order to press the cover onto the spine and fixed to a supporting plate;
- lateral pressing rails which are mounted on the supporting plate such that they can be displaced horizontally and moved under control by an actuating device so as to press on side surfaces close to the spine, it being possible for the spine pressing plate and the side pressing rails to be moved forward synchronously in a cyclic back and forth movement during pressing for the purpose of book block transport and, during the return movement, being guided at a distance from the spine;
- coupling rods, which are attached at joint points outside the supporting plate that is moved back and forth and are connected in an articulated manner at the other end to the side pressing rails, directly or via an intermediate mechanism moved together with the supporting plate, and the joint points located on the outside are controlled such that they can be displaced along the conveying direction of the book block transport system.

Further prior art relating to cover placement technology is described in German patent DE 33 40 859 C1, German published patent application DE 37 41 989 A1, Swiss patent CH 433 186, U.S. Pat. No. 4,153,963 and in Japanese published patent application JP 2000-168264 A.

The mechanical elements of the multilink cam and/or joint mechanisms are affected by tolerances and not free of play and are subject to wear on account of the high loading.

In order to achieve the desired quality from the point of view of position accuracy of the cover in relation to the book block and durability of the adhesive binding, movement sequences and pressing pressures must correspond very accurately to the technological stipulations. As a resulting of the additionally increased requirement to be able to process various materials (adhesive backing materials and cover materials) having highly different characteristics (e.g. flexibility, deformability), adaptation of the process steps "pressing onto the block spine" and "pressing on the block side" has become necessary.

SUMMARY OF THE INVENTION

It is therefore an object of the present invention to provide an apparatus which is improved as compared with the heretofore known devices, which overcomes at least one of the indicated disadvantages of the prior art, and which satisfies the increased requirements on the product quality to be achieved.

It is a further object of the present invention to provide a method which is improved as compared with the heretofore known devices, which overcomes at least one of the indicated disadvantages of the prior art, and which satisfies the increased requirements on the product quality to be achieved.

With the above and other objects in view there is provided, in accordance with the invention, an apparatus for pressing a cover onto a printing material block moving in a transport direction. The novel apparatus comprises:

a first pressing element movably disposed in a first direction;

at least one second pressing element movably disposed in a second direction substantially transverse to the first direction; and a drive unit for driving the apparatus configured to receive a variable control profile through a connection to a control unit.

In other words, the apparatus according to the invention for pressing a cover onto a printing material block moved in a transport direction, has a first pressing element that can be moved in a first direction and at least one second pressing element that can be moved in a second direction substantially transverse with respect to the first direction. The apparatus is distinguished by the fact that it includes a drive unit to which a variable control profile can be applied, or is applied, via a connection to a control unit.

As a result of the provision according to the invention of a drive unit to which a variable control profile can be applied, that is to say a variable or replaceable control profile is made available to the drive unit, it is advantageously possible to adapt the pressing procedure, in particular the movement profile (preferably path profile of the movement and speed profile of the movement and also force profile or pressure profile during the pressing) of the second pressing element, to the product to be processed or produced. As a result, products of better quality can be produced.

In accordance with a development of the apparatus according to the invention which is advantageous, the drive unit comprises a servo motor, a spindle and a displaceable element or a linear servo motor.

In accordance with an added feature of the invention, the apparatus can be distinguished by the fact that the drive unit is decoupled mechanically from a drive for moving the first pressing element and/or from a drive for moving the printing material block.

A further development of the apparatus according to the invention which is advantageous can be distinguished by the fact that the apparatus comprises a coupling rod, which transmits the movement produced by the drive unit to the second pressing element.

A further development of the apparatus according to the invention which is advantageous can be distinguished by the fact that the drive unit and/or the second pressing element sends feedback to the control unit via the connection in order to check, adapt and/or correct the control profile.

A further development of the apparatus according to the invention which is advantageous can be distinguished by the fact that the first pressing element is a pressing table that can be moved in the vertical plane, that the second pressing element is a pressing rail that can be moved in the horizontal plane, that the apparatus comprises a third pressing element, which is likewise a pressing rail that can be moved in the horizontal plane, and that two drive units driving the two pressing rails comprise a respective servo motor to which a variable control profile can be applied.

The scope of the invention is also seen to include a machine for processing printing material, in particular an adhesive binder or a pressing station of an adhesive binder, which is provided with at least one apparatus according to the summary above.

With the above and other objects in view there is also provided, in accordance with the invention, a method for pressing a cover onto a printing material block. The novel method comprises the following method steps:

moving the printing material block in a transport direction;

with a first pressing element mounted for movement in a first direction, pressing the cover onto the printing material block;

with at least one second pressing element mounted for movement in a second direction substantially transverse to the first direction, pressing the cover onto the printing material block, and thereby controlling the movement in the second direction as a function of a variable control profile.

In other words, the method according to the invention is distinguished by the fact that the movement in the second direction is carried out as a function of a variable control profile.

When the method according to the invention is carried out, advantages result, as has already been described above in relation to the apparatus according to the invention.

A development of the method according to the invention can be distinguished by the fact that the pressing with the second pressing element is carried out mechanically decoupled from the pressing with the first pressing element.

In accordance with a concomitant feature of the invention, the control profile is checked, adapted and/or corrected as a function of feedback from the second pressing element or a drive unit assigned to the latter.

The invention described and the advantageous developments of the invention that are described also constitute advantageous developments of the invention in any desired combination with one another.

Other features which are considered as characteristic for the invention are set forth in the appended claims.

Although the invention is illustrated and described herein as embodied in apparatus and method for pressing a cover onto a moving printing material block, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The drawing FIGURE is a perspective view of an apparatus according to the invention.

DESCRIPTION OF THE PREFERRED EMBODIMENT

Referring now to the sole figure of the drawing in detail, there is shown an apparatus 1 according to the invention. The apparatus 1 is preferably used in an adhesive binding machine 100, as a detail of which the apparatus 1 is shown by way of example, for the production of brochures or so-called soft cover products. The apparatus 1 can also be used in other machines, however, for example in endpaper gluing machines, for the production of book blocks for so-called hard cover products. The apparatus 1 can also be implemented as part of a pressing station 110 of the machine 100.

A printing material block or book block 2 composed of collected signatures, for example paper sheets (designated a block in the following), is held or clamped in transport tongs 4 and guided and conveyed by the tongs 4 in the transport direction 6 along a straight line at a substantially constant speed.

At the machine position of the apparatus 1, a cover 8 is pressed onto the block 2, preferably from below in the vertical direction (upward) and, in the process, is joined to the spine 10 of the block 2, preferably adhesively bonded or glued. The spine 10 and/or the cover 8 is previously provided, i.e. in a preceding station of the machine 100, with an application of adhesive or glue, for example with hot melt adhesive or with cold glue. In this text, the term "cover" is understood not only as a cover as such but also any other flexible flat object, for example an end paper, a slip-fold material or any other adhesive backing material.

The cover 8 is pressed on by way of a vertical movement 12 (up and down movement) of a frame 13, which carries a first pressing element (or pressing plate) 16, in particular a pressing table 16, along the rails 14 of the apparatus 1. This creates the necessary pressure for the joining of the cover 8 and the block 2.

In order to be able to follow the transport movement of the block 2 during the pressing, the pressing table 16 is mounted as a carriage on a rail 18 of the frame 13 and can be moved or displaced. The pressing table 16 carries out a horizontal movement 20 (back and forth movement) during the pressing, which is carried out in parallel to the transport direction 6 and during the forward movement at a uniform speed corresponding to the transport speed of the block 2. The pressing thus takes place during a synchronous running phase between the transported block 2 and the moving pressing table 16.

Since the cover 8 is also joined to the block 2 in side regions of the block 2 that are close to the spine, in addition to in the region of the spine 10, the application of the adhesive or glue (in the preceding station of the machine 100) is also carried out in these side regions.

The lateral pressing of the cover 8 in the side regions is carried out by means of a transverse movement 22 of at least one second pressing element 24 or a second and third pressing element 24 (movement toward each other and away from each other), in particular by respective lateral pressing rails 24 on each side of the apparatus 1 and of the block 2. To this end, the pressing rails 24 are mounted on respective rails 30 of the pressing table 16 and can be moved or displaced. The distance of the pressing rails 24 from each other is initially a certain amount greater than the block thickness (extent of the block 2 transversely with respect to the transport direction 6). This "entry width", as it is known, (corresponds to the block thickness plus twice the lateral entry distance between block 2 and pressing rail 24) is kept substantially constant over a specific movement travel of the pressing table 16 (in a first phase of the lateral pressing). After that (in a second phase of the lateral pressing), the pressing rails 24 move toward each other in synchronism with the block 2 and press the cover on laterally.

As a result of the superimposition of the vertical movement 12 on the horizontal movement 20, the pressing table 16 completes a path movement 26. Furthermore, as a result of the superimposition of the horizontal movement 20 on the transverse movement 22, the pressing rails 24 complete respective opposite path movements 28, the path movements 28 further having the path movement 26 superimposed on them.

The production of the pressing movement (transverse movement) of the respective pressing rails 24 is preferably carried out by a respective drive unit 32, preferably arranged in a fixed location or fixed to the frame (in relation to the frame 31 of the apparatus 1) on each side of the apparatus 1, that is to say each pressing rail 24 is preferably assigned an individual drive unit 32.

The drive unit 32 comprises a servo motor 34 which can preferably be activated separately and which drives a rotatable spindle 36 (e.g. via a toothed belt or another transmission element—not illustrated for the purpose of clarity). The rotational movement of the spindle 36 introduced by the servo motor 34 is converted into a controllable transverse movement 22 of a displaceable element 38 (via a spindle nut—not illustrated for the purpose of clarity—in the interior of the displaceable element 38).

As an alternative to the described economical drive unit 32 with servo motor 34 and linear unit comprising spindle 36 and displaceable element 38, a drive unit 32 having a linear servo motor 34' can also be used.

Attached to the displaceable element 38 by its first end on the drive side is a coupling rod 40, which transmits the transverse movement 22 from the drive unit 32 or from the displaceable element 38 to the pressing rail 24 assigned to it. For this purpose, the coupling rod 40 is also attached at its second end, on the output drive side, to the pressing rail 24 assigned to it. The joint point 42 of the coupling rod 40 on the drive side can thus be displaced under control in a manner corresponding to the controllable transverse movement 22 of the displaceable element 38. The joint point 42 on the drive side is preferably located in the lateral direction (transversely with respect to the transport direction 6) outside the region of the horizontally moved (back and forth movement) pressing table 16.

An electronic control unit 120 is in contact with the two servo motors 34 via a connection 124, for example via a cable connection (wire-bound) or radio connection (wire-free) and applies to the servo motors 34 electronic control profiles 122 which represent movement profiles of the associated pressing rails 24. The two servo motors 34 preferably have the same control profile 122 applied to them. However, it is also possible to assign different control profiles 122 to the two servo motors 34, for example if the block thickness is not built up symmetrically with respect to the apparatus 1.

The control profiles 122 can be stored in an electronic memory in prepared form and can be assigned to predefined processing jobs. Additionally or alternatively, the control profiles 122 can be calculated individually as a function of predefined processing jobs, that is to say as a function of specific parameters such as movement or movement profile of the pressing table 16, block thickness, offset, entry width, pressing position, pressing length and/or pressing force or pressing pressure. Furthermore, each of the two servo motors 34 can have an individual, preferably integrated, control unit 120.

The servo motors 34 are able to output feedback to the control unit 120 via the existing connection 124, so that the control profiles 122 can also be checked, adapted and/or corrected. Alternatively, the connection 124 can also comprise two separate connections for the transmission of the control profile 122 and for the feedback.

The pressing pressure achieved is directly dependent on specific material parameters, for example on the total thickness of block 2 with cover (corresponds to the block thickness plus twice the cover thickness), apart from the mechanical parameters of the apparatus 1. In the event of fluctuation of these material parameters during the production, the pressing pressure actually achieved by the lateral pressing rails 24 also changes. By means of feeding back to the control unit 120 the pressing pressure actually achieved, which, for example, can be determined by the load current on the servo motor 34, corrections to the control profile 122 used can be made even during continuous production.

Furthermore, the control unit 120 is able to receive signals or data from sensors which register the material parameters, for example the block thickness or the lateral position of the block or of the block sides, during continuous production. Thus, the current control profile 122 can be checked, adapted and/or corrected even during continuous production, preferably in real time, so that each individual block 2 is provided with a cover 8 optimally.

The movement of the pressing rails 24 is carried out with activation by the control unit 120 in such a way that one or more of the following parameters is taken into account: movement or movement profile of the pressing table 16, block thickness, offset, entry width, pressing position, pressing length and/or pressing force or pressing pressure.

The invention is also based on the idea of simplifying the drives known in the prior art, for example cam disks, for pressing rails and the mechanical actuating devices assigned to them, for example eccentrics, and of combining their functions (drive and displacement) in one unit. As a result of combining the functions in one unit, in this exemplary embodiment in the drive unit 32, and as a result of providing control of the unit, in this exemplary embodiment by means of the control unit 120, it advantageously becomes possible to apply any desired movement profiles to the pressing rails in a simple way and with few technical means and thus to control them specifically in terms of their movement.

The invention is, moreover, also based on the idea of eliminating the mechanical coupling of the transverse movement of the pressing rails, provided in the prior art, to other movements, for example to the transport movement of the block or to the horizontal movement or vertical movement of the pressing table, and of decoupling the transverse movement.

The apparatus 1 according to the invention and its use and also the method according to the invention lead to the following further advantages:

- It is possible to adjust the stroke and also the course of the stroke of the lateral pressing rails in a variable manner;
- It is possible to use substantially completely and optimally the time windows, which are inversely proportional to the machine speed and can be used to the maximum, for the pressing operation;
- It is possible to reduce the moving masses and the number of components. Associated with this, reducing play in the transmission elements and thus greater accuracy in the desired movement of the lateral pressing rails;

It is possible to additionally prolong the process times for the lateral pressing at machine speeds below the nominal speed by way of variable control times;

It is possible to increase the process reliability by way of possible adjustment of the process variables pressing pressure and/or pressing force, and associated improvement of the end product; and/or It is possible to reduce the component loading by adjusting the pressing force as a function of material characteristics and the amount of adhesive area to be pressed.

We claim:

1. An apparatus for pressing a cover onto a printing material block moving in a transport direction, the apparatus comprising:

a first pressing element movably disposed in a first direction;

at least one second pressing element movably disposed in a second direction substantially transverse to said first direction; and a drive unit for driving the apparatus configured to receive a variable control profile through a connection to a control unit, said variable control adapting a path profile of the movement, said variable control profile setting an entry width of said at least one second pressing element in a first phase of lateral pressing and said variable control profile controlling a movement of said at least one second pressing element during a second phase of lateral pressing defined by an actual pressing of cover on the block.

2. The apparatus according to claim 1, wherein said drive unit comprises a servo motor, a spindle, and a displaceable element.

3. The apparatus according to claim 1, wherein said drive unit comprises a linear servo motor.

4. The apparatus according to claim 1, which comprises a drive for moving said first pressing element and a drive for moving the printing material block, and wherein said drive unit is mechanically decoupled from at least one of said first drive for moving said first pressing element or said drive for moving the printing material block.

5. The apparatus according to claim 1, which comprises a coupling rod connected to transmits a movement produced by said drive unit to said at least one second pressing element.

6. The apparatus according to claim 1, wherein at least one of said drive unit and said at least one second pressing element are connected to send feedback to said control unit via the connection, enabling the control profile to be checked, adapted, and/or corrected.

7. The apparatus according to claim 1, wherein:

said first pressing element is a pressing table mounted for vertical movement;

said at least one second pressing element is a first pressing rail mounted for substantially horizontal movement;

a second pressing rail forming a third pressing element is mounted for substantially horizontal movement; and said drive unit includes two servo motors for driving said first and second pressing rails, respectively, and said servo motors are connected to receive a variable control profile.

8. In a printing material processing machine, the apparatus according to claim 1.

9. In an adhesive binder processing printing material, the apparatus according to claim 1.

10. In a pressing station of an adhesive binder processing printing material, the apparatus according to claim 1.

11. A method for pressing a cover onto a printing material block, the method which comprises:

moving the printing material block in a transport direction;

with a first pressing element mounted for movement in a first direction, pressing the cover onto the printing material block;

with at least one second pressing element mounted for movement in a second direction substantially transverse to the first direction, pressing the cover onto the printing material block, and thereby controlling the movement in the second direction as a function of a variable control profile, the variable control adapting a path profile of the movement, the variable control profile setting an entry width of said at least one second pressing element in a first phase of lateral pressing and the variable control profile controlling a movement of the at least one second pressing element during a second phase of lateral pressing defined by an actual pressing of cover on the block.

12. The method according to claim 11, which comprises carrying out the step of pressing with the second pressing element mechanically decoupled from the step of pressing with the first pressing element.

13. The method according to claim 12, which comprises providing feedback from the second pressing element or a drive unit assigned thereto, and checking, adapting, and/or correcting the control profile in dependence on the feedback.

14. An apparatus for pressing a cover onto a printing material block moving in a transport direction, the apparatus comprising:

a first pressing element movably disposed in a first direction;

at least one second pressing element movably disposed in a second direction substantially transverse to said first direction; and a drive unit for driving the apparatus configured to receive a variable control profile through a connection to a control unit, said variable control profile adapting a speed profile of the movement, said variable control profile setting an entry width of said at least one second pressing element in a first phase of lateral pressing and said variable control profile controlling a movement of said at least one second pressing element during a second phase of lateral pressing defined by an actual pressing of cover on the block.

15. The apparatus according to claim 1, wherein said variable control profile adapts a force profile during pressing.

16. The apparatus according to claim 1, wherein said variable control profile adapts a pressure profile during pressing.

* * * * *